US006047774A

United States Patent [19]

Allen

[11] Patent Number: 6,047,774

[45] Date of Patent: Apr. 11, 2000

[54] SYSTEM FOR DRILLING AND COMPLETING MULTILATERAL WELLS

[75] Inventor: David W. Allen, Aberdeen, United Kingdom

[73] Assignee: Phillips Petroleum Company, Bartlesville, Okla.

[21] Appl. No.: 09/051,325

[22] PCT Filed: Jun. 9, 1997

[86] PCT No.: PCT/US97/09995

§ 371 Date: Apr. 7, 1998

§ 102(e) Date: Apr. 7, 1998

[87] PCT Pub. No.: WO98/57031

PCT Pub. Date: Dec. 17, 1998

[51] Int. Cl.[7] ..... E21B 7/06

[52] U.S. Cl. ..... 166/313; 166/50; 166/117.5

[58] Field of Search ..... 166/313, 50, 117.5, 166/117.6, 381

[56] References Cited

U.S. PATENT DOCUMENTS

| | | | |
|---|---|---|---|
| 4,396,075 | 8/1983 | Wood et al. | 175/79 |
| 4,807,704 | 2/1989 | Hsu et al. | 166/313 |
| 5,462,120 | 10/1995 | Gondouin | 166/380 |
| 5,533,573 | 7/1996 | Jordan, Jr. et al. | 166/313 |
| 5,564,503 | 10/1996 | Longbottom et al. | 166/313 |
| 5,944,107 | 8/1999 | Ohmer | 166/313 |

*Primary Examiner*—David Bagnell
*Assistant Examiner*—Zakiya Walker
*Attorney, Agent, or Firm*—George E. Bogatie

[57] ABSTRACT

The time required for establishing a multilateral well is reduced by enlarging a section of a wellbore and running a multilateral tool into the enlarged wellbore section. The multilateral tool, which is suitable for running into a wellbore on a primary casing string, includes a preassembled combination of casing sections that are used to form dual casings strings extending from the primary casing. The multilateral tool incorporates three casing sections, which maintain the diameter of the primary casing, including: a carrier section, a lateral section, and a main section. In use, the tool is run with the lateral section releasably held in coaxial alignment within the carrier section, and with the main casing section fixed to the lower end of the carrier section. Once in place in the enlarged section of the wellbore, the lateral section is released and diverted out of a preformed window in the lower end of the carrier section and runs generally parallel to the main casing section. In this manner a lateral junction is formed at the carrier casing window in which dual casing strings are connected to the primary casing. A second window, which is preformed in the upper end of the lateral section is aligned with the bore of the primary casing when the lateral casing section is fully extended out of the carrier section window, thus permitting recovery of a diverting device incorporated in the carrier casing section through the second window. The dual strings are then individually drilled and completed to target locations with pressure integrity between the dual strings maintained by using straddle equipment across the lateral junction.

17 Claims, 11 Drawing Sheets

SYSTEM FOR DRILLING AND COMPLETING MULTILATERAL WELLS

This invention relates to downhole oil well tools, and particularly to a multilateral tool used for reducing the time required for drilling and completing multiple wells that extend laterally from a main wellbore. More specifically, this invention relates to a method for assembling well parts to simplify completion of multiple wells extending laterally or vertically into the same or different producing formations from a common wellbore, with full pressure integrity between wells.

BACKGROUND OF THE INVENTION

Multilateral well drilling and production, where separately spaced apart wells extend laterally from a common wellbore, have become increasingly important to the oil industry in recent years, both from the standpoint of new drilling operations, and from the standpoint of reworking existing wellbores. A multilateral well completion frequently improves production to a point that offsets the increased drilling and completion costs. This increased production from multilateral wells, where the lateral wells can be inclined or even horizontal, minimizes the number of production trees required on shore, and likewise minimizes the number of offshore platforms required to maintain a desired production rate. Further, other equipment costs such as casing, tubing, wellheads, bits, muds and other drilling items are reduced. Multilateral drilling also makes petroleum reservoirs in urban areas, permafrost zones, deep offshore waters and faulted reservoirs more accessible for economic recovery. Accordingly, the preferred drilling technique of the future, especially in the oil industry, is multilateral drilling.

However, if the oil industry is to continue to grow, cost reductions are necessary especially in the drilling and completing of multilateral wells. For example, the need to reduce the size and number of offshore platforms while simultaneously developing smaller and often discontinuous reservoirs, which can readily be accomplished with multilateral completions, is an important concern for the oil industry. Accordingly, an urgent need exists for new and improved methods and tools that reduce drilling and completion time required for multilateral wells.

Accordingly, it is an object of this invention to reduce the number and cost of wells required to economically develop oil and/or gas fields.

It is a more specific object of this invention to improve techniques and tools for drilling and completing multilateral wells which can produce oil from separate formation through a single vertical wellbore.

Another object is to drill and complete multilateral wells having full pressure integrity at lateral junctions.

Still, another object is to safely complete several separate reservoirs having different formation pressures from the same well.

Another specific object is to safely complete multiple high pressure reservoirs with a multilateral well.

Yet another object of this invention is to accelerate production and cash flow by reducing drilling and completion time.

Still, another object is to achieve simultaneous production and injection in the same reservoir in a single well.

SUMMARY OF THE INVENTION

According to the present invention, the foregoing and other objects and advantages are attained by running one or more multilateral tools in a casing string, where the multilateral tool serves to speed up drilling and completion operations for multilateral wells. This multilateral tool is a preassembled combination of well casings and accessories that can be run into a wellbore at any suitable depth on a single primary casing string, and the well casings of the tool used to expand the primary casing to provide dual casing strings extending from the single primary casing string. The multilateral tool, which includes three casing sections, is attachable to the primary casing and erects casing sections arranged in the following structural order: a main casing section at the lower end, and a carrier casing section coaxially containing a lateral casing section at the upper end of the multilateral tool. The carrier casing section has a window and a recoverable diverting device aligned with the carrier window in its lower end, and is adapted for coaxially receiving the lateral casing section in its upper end.

The lateral section can be longitudinally advanced to contact the diverting device in the lower end of the carrier section, and diverted out of the carrier section through the carrier window. When fully advanced through the carrier section, a major length of the lateral casing section extends out of the carrier window and runs generally parallel to the main casing section. Accordingly, a dual casing configuration connected to the primary casing is established with an unsealed lateral junction at the carrier casing window.

The lateral casing section has a preformed window in its upper end, which is prealigned with the diverting device, and the lateral section is advanced through the carrier section without rotation to correctly position the lateral casing window for recovery of the diverting device. The diverting device can then be recovered through the lateral casing section window. A coupling for releasably attaching the lateral section to the carrier section is also provided. In use for establishing a multilateral well, straddle equipment is provided across the lateral junction during drilling and production for pressure integrity in each of the dual casings.

In accordance with another aspect of the invention, a method for drilling and completing multilateral wells comprises running the multilateral tool on a primary casing into an enlarged section of a wellbore. The lateral casing section is then extended through the preformed carrier casing window at a small angle from the axis of the carrier section and into the enlarged section of the wellbore, thus forming a lateral junction at the window with dual casing sections running generally parallel to each other in the enlarged section of the wellbore. The method and apparatus of this invention described to this point provides dual casing strings, hereinafter referred to as a main string and a lateral string, which are joined to the primary wellbore casing and which maintain the diameter of the primary casing. Further the dual casing sections can be rapidly installed in a wellbore because the multilateral tool is assembled on the surface prior to running the tool into the wellbore.

The lateral string can be further drilled to the depth of the next hole section, and an intermediate diameter liner run and cemented. To provide pressure integrity in the lateral string while drilling a hole for a production liner, the lateral junction is straddled with a scab tieback liner that is sealed at the upper end with retrievable tieback packers. An unperforated production liner for the lateral string is then run and cemented and the tieback liner in the lateral string is recovered. Next the diverting device is recovered, and drilling and lining the main casing string to a production zone is carried out in the same manner described for the lateral string. The well can then be completed either commingled, or with dual tubing strings by running smaller diameter tubing in the casings to straddle the lateral junction for pressure integrity between the dual casing strings, sealing the tubing with permanent scab tieback packers, and perforating the production liners.

In one preferred embodiment, the multilateral tool, which for example can include casing section diameters of $$9\frac{5}{8}''$$

for both the main and lateral casing sections and a greater diameter for the carrier section, is assembled on the surface and then run into the wellbore at the bottom of a casing string. The diverting device, such as a whipstock, having been prepositioned in the carrier casing section using an integral orienting sub during fabrication, is also aligned with the window on the lateral casing section during fabrication. After installation of the multilateral tool, the dual casing strings are extended using a casing configuration of a 7-inch intermediate liner, and a $$4\frac{1}{2}''$$

inch production liner. Other casing configurations are also contemplated for use in this invention, such as $$10\frac{3}{4}'' \times 7\frac{5}{8}'' \times 5''$$

and a $$11\frac{3}{4}'' \times 8\frac{5}{8}'' \times 5\frac{1}{2}''$$

configurations.

In another preferred embodiment two or more multilateral tools, configured with main and lateral casing sections as recited above, are run at spaced apart levels in a primary casing string. Then extending the lateral casing from each multilateral tool provides multiple lateral branches corresponding to the number of multilateral tools employed.

Other objects, advantages and novel features of the present invention will be apparent to those skilled in the art from the following description of the preferred embodiment and the appended claims, and the drawings in which:

BRIEF DESCRIPTION OF THE DRAWINGS

FIGS. 4(*b*)–4(*c*) are views similar to FIG. 4(*a*) showing a tieback liner-top packer and a tieback seal assembly used with straddle tubing across the lateral junction of FIG. 4(*a*).

DESCRIPTION OF THE PREFERRED EMBODIMENT

Figure 1:
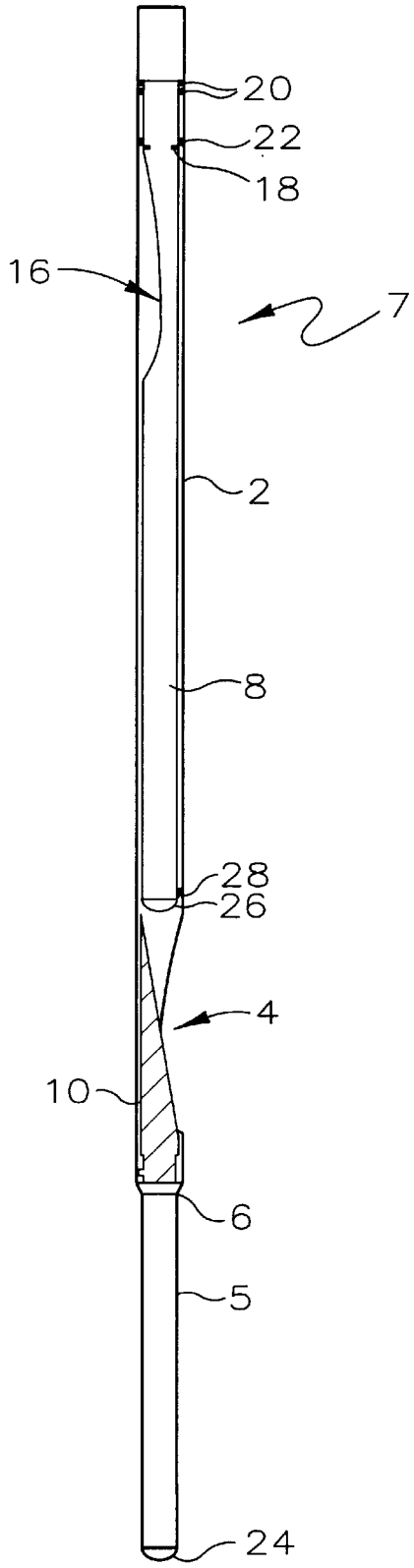
FIG. 1 is a elevation view partially in section of a multilateral tool, according to the invention.
Figures 2A, 2B, 2C, 2D, 2E:
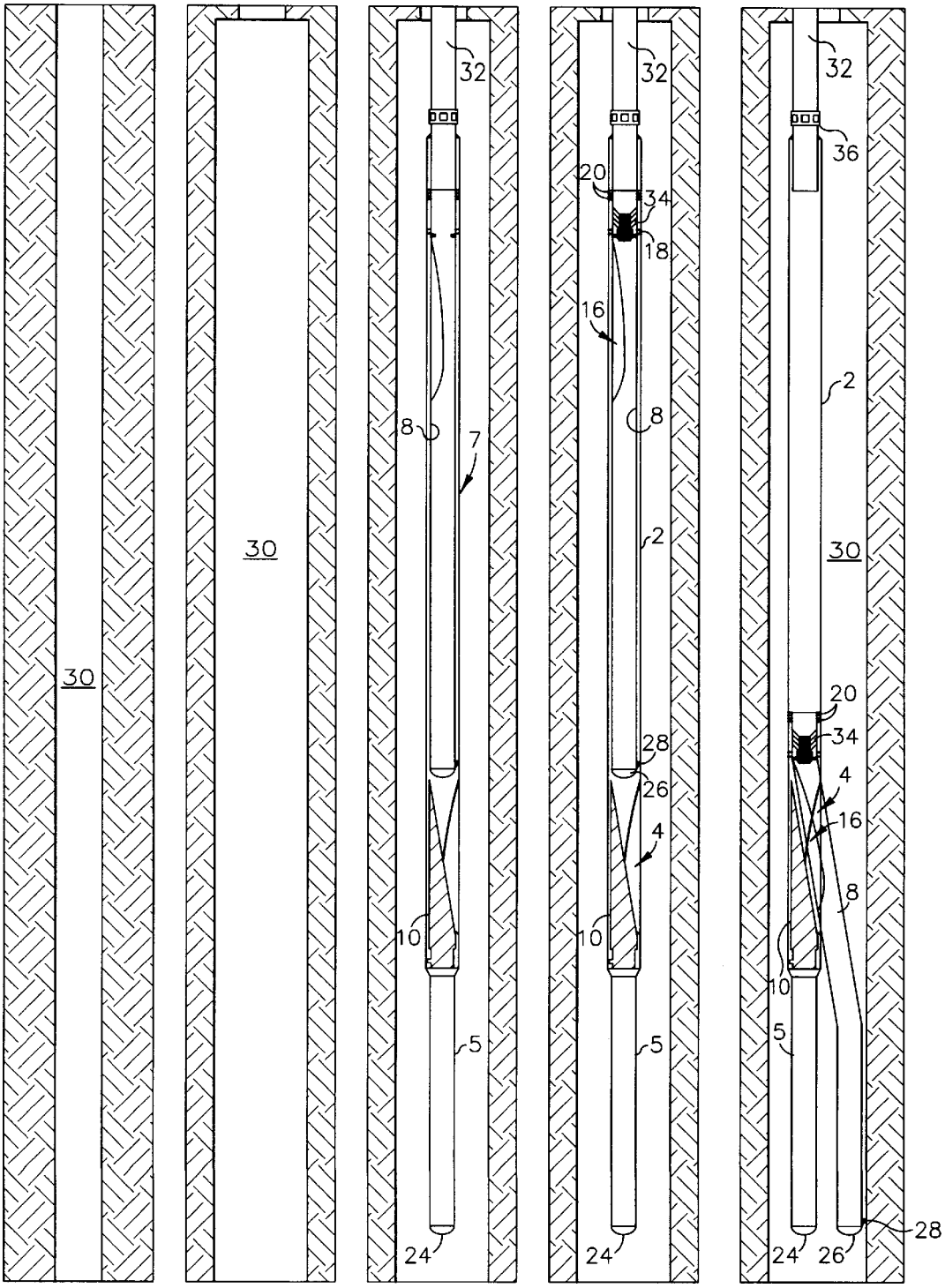
FIGS. 2(*a*)–2(*s*) are sequential elevation views partially in section illustrating a method for completing dual well casing strings using the multilateral tool of FIG. 1, according to this invention.
Figure 2F:
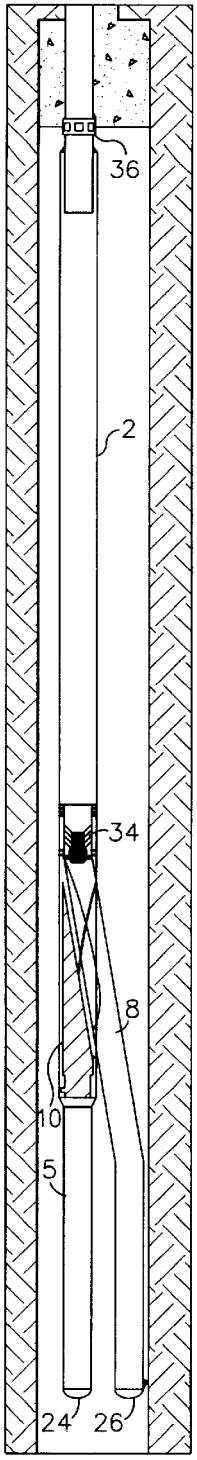
Figure 2G:
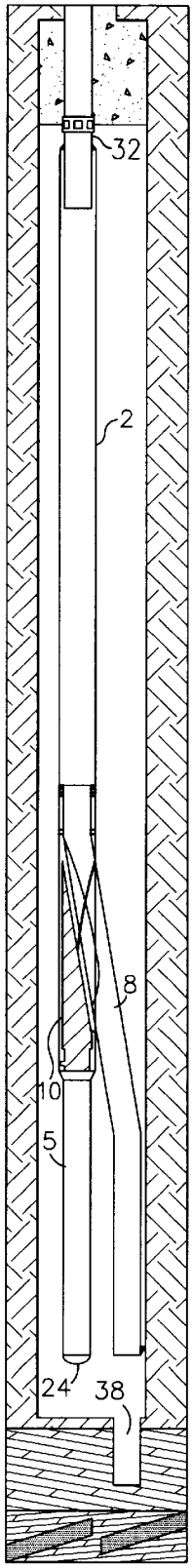
Figure 2H:
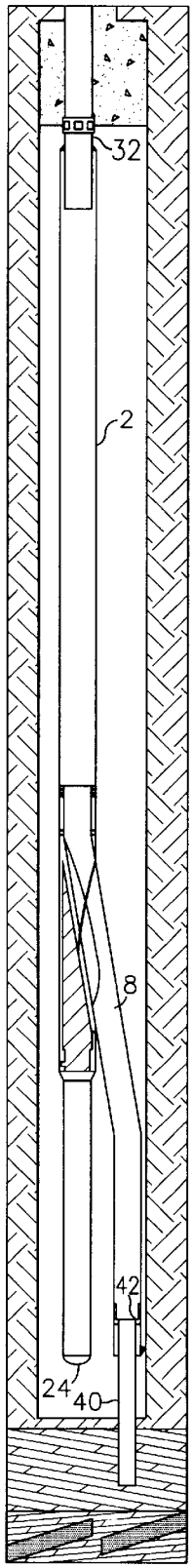
Figure 2I:
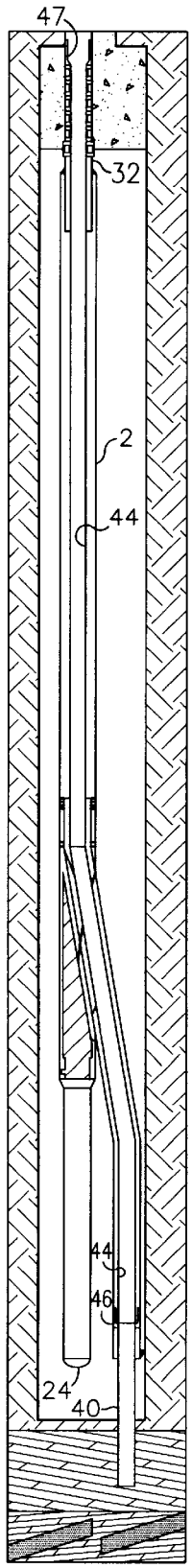
Figure 2J:
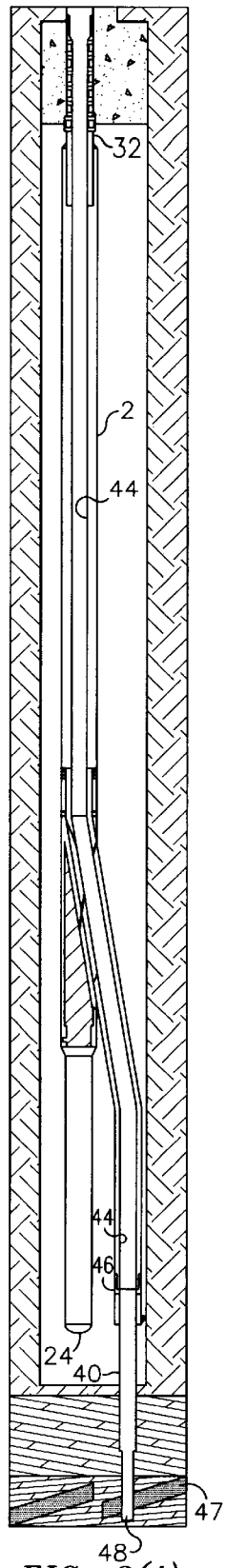
Figures 2K, 2L, 2M, 2N, 2O:
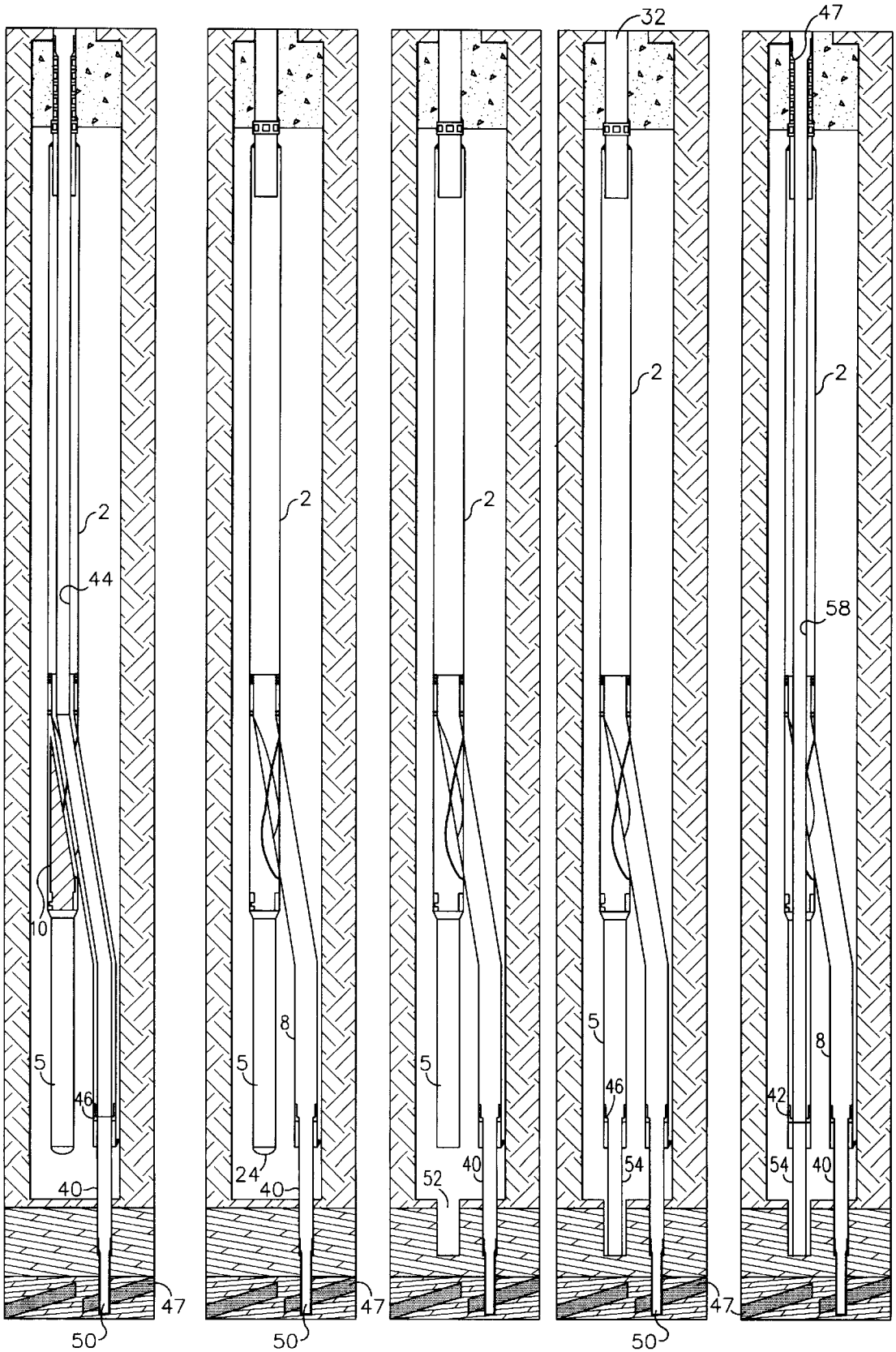
Figure 2P:
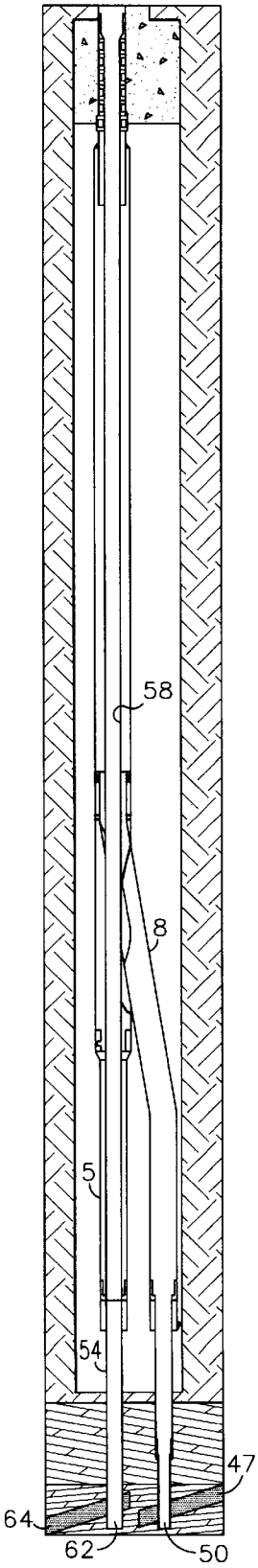
Figure 2Q:
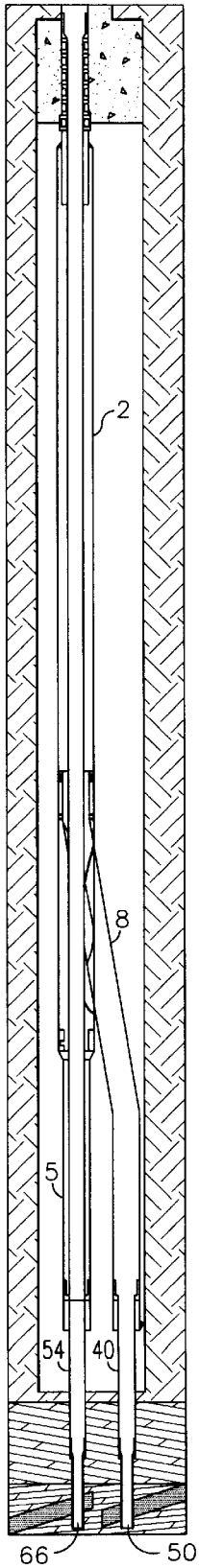
Figure 2R:
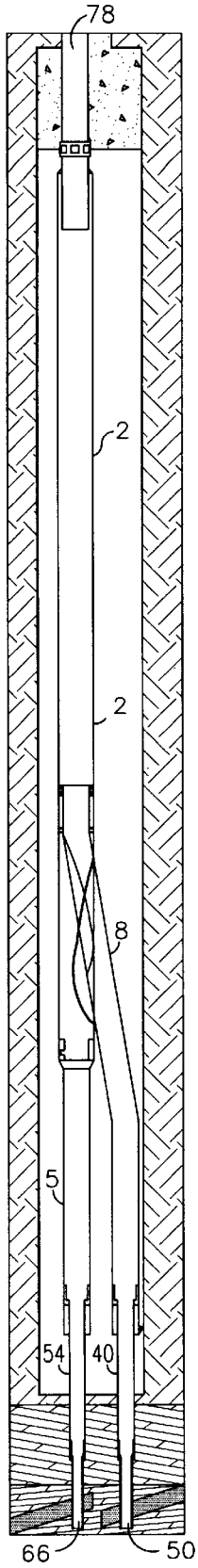
Figure 2S:
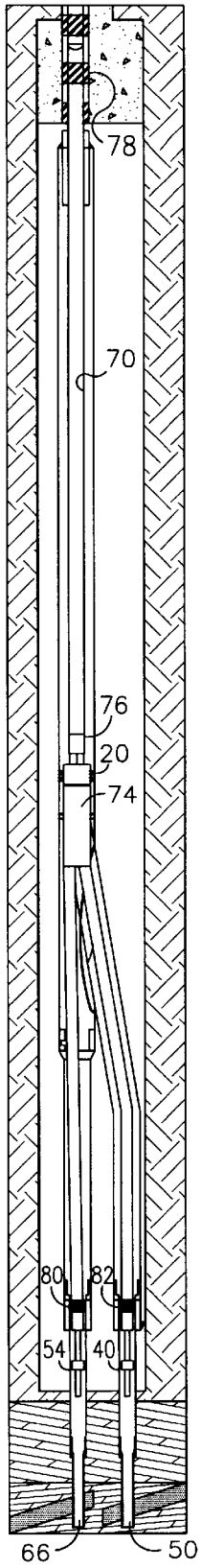

In the description which follows, like parts are marked with the same reference numeral throughout the specification and the various drawing figures. Many of the drawings depict deep wells and/or elongated tubular downhole tools, and accordingly the drawings are vertically shortened. Also, some details of conventional elements may not be shown in the interest of clarity and conciseness. In accordance with the present invention, various terms identifying sections of well casings are used herein. It will be appreciated that although terms such as primary, carrier, lateral, main, conductor, and structural are used for identifying particular sections of well casings, all of these terms refer to a tubular steel conduit having a longitudinal axis, with the conduits being of sufficient length and thickness to posses a sufficient degree of flexibility, and where such conduits are used for protecting a well bore from caving and from fluid contamination.

Referring now to FIG. 1 there is illustrated a sectional elevation view of a generally tubular shaped multilateral tool according to the present invention. This multilateral tool, illustrated generally at 7, includes a carrier casing 2 having a window preformed at a desired kick-off angle for the lateral casing section 8. The window, which is covered with a plastic material while running the tool is generally illustrated at 4. A main casing section 5 is permanently connected to the lower end 6 of the carrier casing section 2. As illustrated, a lateral casing section 8 is closely positioned inside, and coaxially aligned within the upper portion of the carrier casing 2 for hydraulically or mechanically advancing of the lateral section 8, therethrough. When the lateral section 8 is fully advanced, along the inner surface of the carrier casing 2, a major length of the casing section 8 extends out of the window 4. Accordingly, the lateral casing section 8 is releasably attached to the carrier casing 2 by any suitable means such as shear pins (not illustrated) when running the tool in a wellbore. A whipstock 10, is preinstalled at the lower end 6 of the carrier casing 2 in cooperation with an integral orienting sub illustrated at 12. The orienting sub is used to align the whipstock 10 with the preformed carrier casing window 4. A second preformed window, which is oriented in the opposite direction of the carrier casing window 4, is generally illustrated at 16. The window 16, located in the upper portion of lateral casing section 8, is positioned to provide an opening into the carrier casing 2 for recovery of the whipstock 10, when the lateral section 8 is fully extended out of the window 4. Guide means (not illustrated) such as guide pins or other integral structure to guide the section 8 in lengthwise motion, without rotation, may be provided to insure that the window 16 is correctly positioned to permit recovery of the whipstock 10 through the carrier casing 2. Also illustrated in FIG. 1 is a landing collar 18, which is used in conjunction with an opening plug to release the lateral casing section 8 from its attachment to the carrier casing 2, as will be more fully explained hereinafter. Annular sealing devices, which are attached to the lateral casing section 8, are illustrated at reference numerals 20 and 22. These seals 20 and 22, which can be elastomeric or metal to metal depending on the operating environment, are slidable along the inner surface of the carrier casing section 2. Further illustrated in FIG. 1, are guide shoes 24 and 26 attached respectively to main casing section 5 and the lateral casing section 8. A knife edge 28 is positioned near the guide shoe 26 at the lower end of the lateral casing section 8. The knife edge 28 is used to cut a plastic cover (not illustrated) that would be placed over the window 4 when running the multilateral tool 7 in a wellbore.

Specific components which can be used in assembling the multilateral tool as illustrated in FIG. 1, and the various service tool accessories required for drilling and completing a well, referred to hereinafter, are each well known, commercially available components, many of which are described in "Petroleum Engineers Handbook", Howard B. Bradley, Society of Petroleum Engineers, Richardson, Tex. Further, the components used in this invention are listed in catalogs such as "Baker Production and Service Tool Catalogs," Baker Hughes Company, Houston, Tex. or "TIW Catalog," Texas Ironworks Company, Houston, Tex.

The various steps of a method for establishing a multilateral well with pressure isolation between wells provided both while drilling and in the completed well will now be described in more detail with reference to the set of sequential drawings given in FIG. 2(*a*) through FIG. 2(*s*). Referring specifically now to FIG. 2(*a*), there is illustrated a single wellbore section 30 to be used for a lateral hole section. The wellbore section 30, which is sufficient in length to accommodate the multilateral tool shown in FIG. 1, is at a desired depth for reaching target locations with lateral drilling, and extends generally vertically downward. In the next step according to this invention, the wellbore section 30 is enlarged to accommodate a multilateral tool by underreaming, which is a conventional and accepted method to enlarge a wellbore. The enlarged wellbore is shown in FIG. 2(*b*). The multilateral tool 7, as illustrated, is installed at the bottom of the primary casing 32 in FIG. 2(*c*) by any suitable means, and the primary casings is run and landed in a conventional manner. It will be appreciated by those skilled in the art that the tool 7 could be run at any desired depth in the wellbore and that more than one multilateral tool could be employed in a single wellbore. The orientation of the multilateral tool 7 is preferably determined using conventional wellbore surveying equipment, with the tool 7 oriented by rotation of the primary casing string 32. Alternatively, a casing swivel (not illustrated) could be installed above the tool 7, and the tool 7 positioned using a torque tool on a drill or work string. If desired, a mechanical or hydraulically actuated locking mechanism could be installed to prevent rotation of the tool 7 after it is oriented into the desired position or direction.

In the next step according to the invention, an opening plug, illustrated at 34 in FIG. 2(*d*), is launched from the surface of the well and displaced to the landing collar 18. The opening plug 34 is a tool designed to facilitate disengagement of the lateral casing section 8, by landing on the landing collar 18, and thus forming a seal at the upper end of the lateral casing section 8. Accordingly, applied pressure to the opening plug 34 from the surfaces urges the lateral casing section 8 to move downwardly. Although not illustrated in the drawing, but according to generally preferred and accepted practice, a circulating path through the lateral casing section guide shoe 26 would be provided, including a flow path for the displacement fluid from the guide shoe 24 of the main casing section 5 to a hole in the face of the whipstock 10, thus directing flow through the whipstock 10 and the main casing section guide shoe 24. After landing the opening plug 34 on the landing collar 18, applied pressure from the surface is used to shear a set of shear pins (not illustrated), thus imparting tool activation and forcing the lateral casing section 8 to advance downwardly within the carrier casing section 2. In this step as illustrated in FIG. 2(*e*), the downward force on the lateral casing section 8 diverts or kicks off the lateral section 8 out the preformed window 4 when the leading end of lateral section 8 contacts the whipstock 10. A knife edge 28 on the lateral casing section will split the plastic cover over the preformed window 4, and a major portion of the lateral casing section 8 is run out of the window 4 and generally parallel to the main casing section 5 in the underreamed wellbore section 30, thus forming a lateral junction at the window 4. In the stage of well construction shown in FIG. 2(*e*), the section 8 is fully extended and the window 16 is positioned to permit recovery of the whipstock 10 through the carrier casing section 2.

Next, as shown in FIG. 2(*f*), the primary casing 32 above the stage collar 36 is cemented. In this step the hydraulic stage collar 36 is opened by increasing hydraulic or mechanical pressure on the collar, and the cement is pumped and displaced in a conventional manner. Referring next to FIG. 2(*g*), the opening plug 34, and the shoe 26 of the lateral casing section 8 are drilled out, and a hole 38 of a reduced diameter compared to the diameter of the lateral casing section 8 is illustrated as being drilled generally vertical into the earth to the next casing depth. As illustrated, the hole 38 extends generally vertically downward from the underreamed wellbore section 30, however, the hole 38 could extend laterally at any desired angle into the earth in accordance with the method of the present invention. Referring now to FIG. 2(*h*), a liner 40 is run from a hanger 42 into the hole 38 and the liner is cemented in a conventional manner. A landing profile or slip type liner hanger or other means for ensuring an exact positioning of the top of the liner 40 relative to the lower end of the lateral casing section 8 may be used. In the next step shown in FIG. 2(*i*), the polished bore receptacle of the hanger 42 is dressed off and using a tieback seal assembly 46 shown in FIG. 4(*c*), and a scab tie-back liner 44 is run from the top of the liner 40 to the lower end of the primary casing 32 so as to straddle the lateral junction at the window 4. The top of the scab tie-back liner 44 is sealed with retrievable tieback liner-top packer 47 which is more clearly illustrated in FIG. 4(*b*). With the retrievable liner top packer 47 installed, the annular junction of the scab tie-back liner 44 and the casing section 32 is sealed allowing fluid density to be adjusted as required to drill the next hole section without danger of lost circulation or wellbore influx at the lateral junction formed at the window 4. The shoe track of liner 40 is then drilled out and the next hole section 48 is drilled into a production zone 47, as shown in FIG. 2(*j*).

FIG. 2(*k*) shows the well construction after a production liner 50 has been run and cemented in the hole 48. Further at this stage of well construction the liners 40 and 50 could be cleaned out and the drilling fluid displaced with a completion fluid. If desired a production packer (not illustrated) could also be set at this stage. Also a high-vis gel plug, cement plug, or retrievable bridge plug (none of which are illustrated) would be set at the top of liner 40 and below the scab tie-back liner 44 to prevent any debris from falling into the liner 40 while drilling the next hole section in the main casing string. In the next step the scab tie-back liner 44 and retrievable packer 47 are retrieved using a spear or other conventional tool. Also retrieved is the whipstock 10. In this step the whipstock 10 passes through the window 16, which is illustrated in the sequential FIGS. 2(*e*) through 2(*s*) as being aligned with the longitudinal axis of the primary casing 32, so as to allow withdrawal of the whipstock 10 using conventional tools such as a die collar or alternatively a hook, a washpipe or an overshot. This stage of well construction is illustrated in FIG. 2(*l*). Next the casing shoe 24 of the main casing section 5 is drilled out, and the hole section 52 is illustrated as being drilled generally vertically downward from the lateral hole section 30, as illustrated in FIG. 2(*m*). It is recognized, however, that this hole could be directionally drilled (e.g. horizontally or at any lateral angle), if desired. Next a liner 54 is run, hung and conventionally cemented in hole 52 as shown in FIG. 2(*n*). A profile or slip type liner hanger 42 is preferred for positioning the top of the liner 54. However, other means of ensuring the exact position of the top of the liner 54 are available and known and may be used in the practice of this invention.

The next stage of well construction is illustrated in FIG. 2(*o*), where the polished bore receptacle of the hanger 42 is dressed off, and a scab tie-back liner 58 is run from the top of liner 54 to the inside of primary casing section 32. This scab tie-back liner 58, which straddles the lateral junction at the window 4, is secured in the same manner as the liner 44, where the top of liner 58 is sealed with a retrievable tieback liner top packer 47. With this equipment installed the junction of the scab tie-back liner 58 and the casing section 32 is sealed, allowing the drilling fluid density to be adjusted as required to drill the next hole section 62 without danger of lost circulation or wellbore fluid influx at the window or the lateral junction at the window 4. In the next step, shown in FIG. 2(*p*) the shoe track of liner 54 is drilled out and the hole section 62 is drilled into a production zone illustrated at 64. According to FIG. 2(*q*), the liner 66 is run, hung and conventionally cemented in the hole 62. Also the liners 66 and 54 would be cleaned out and drilling fluid displaced with completion fluid in this step. Referring now to FIG. 2(*r*) the tieback liner 58 and associated packers and tieback seal assemblies are pulled out of casing string including casing sections 32, 2, and 5 in the same manner as described with reference to FIG. 2(*l*).

The completed well is shown in FIG. 2(*s*) where completion is accomplished by running tubing 70 into casings having larger diameters. As illustrated, a deflection block 74 having dual seal assemblies, and a Y-block 76 are run below a production packer 78. The deflector block 74 locates and orients in a profile to align one seal assembly with the window 4 such that setting down string weight kicks over this assembly into the branch. The seal assemblies 80 and 82, tubing 70 and other completion equipment are run conventionally into the liners 54 and 40. For access into a branch below the Y-block 76, a deflector (not illustrated) is run on wireline, coiled tubing or jointed tubing. Tools can then be run through this deflector to perform operations, such as perforating, logging, etc., and the deflector retrieved on completion of the operation. As illustrated in FIG. 2(*s*), production may be commingled to allow use of the larger diameter tubing 70 to the surface for high production rates. If desired, full dual tubing strings with a dual production packer (not illustrated) may be run. With dual completion, production in one branch and simultaneous injection in the other branch is feasible. Conventional gravel and frac packing and reservoir stimulation can be used in the completed well of FIG. 2(*s*) without modification to existing stimulation and sand control techniques or equipment.

Figure 3:
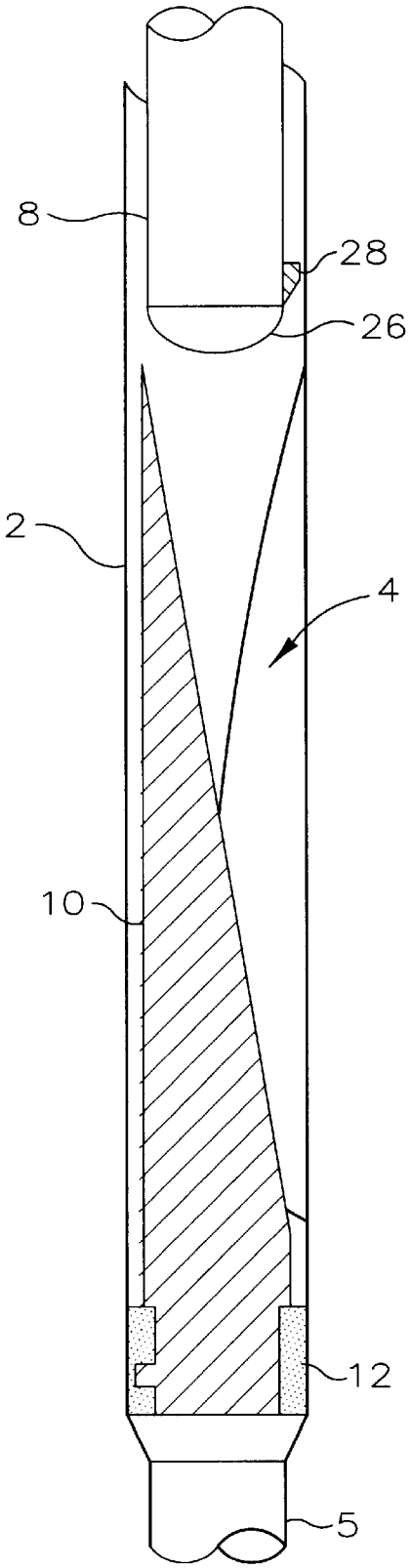
FIG. 3 is elevation partially sectional view showing the alignment of the whipstock with the preformed carrier section window in more detail.

Referring now to FIG. 3, an elevation view partly in section, which is an enlargement of a portion of FIG. 1, showing in more detail the positioning of the whipstock 10 prior to running the tool in the wellbore. The main casing section 5 is shown permanently attached to the lower end 6 of the carrier casing 2. An orienting sub 12, which is a short section of pipe with a keyslot that aligns with a locator key 15 on the whipstock 10, is used to position and correctly orient the whipstock 10 to deflect the lateral carrier section 8 out of the window 4.

Figure 4:
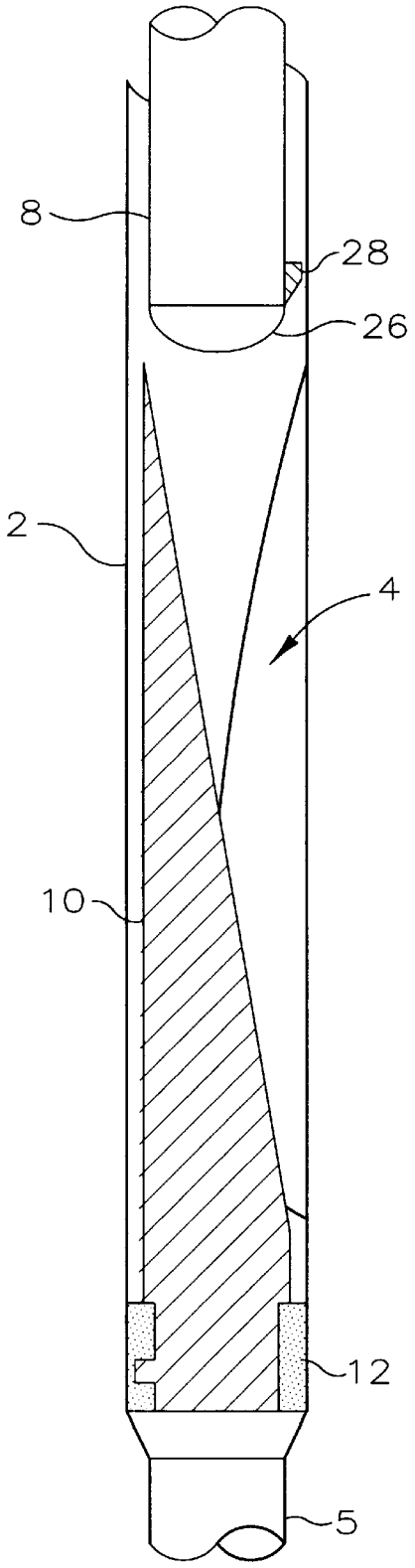
FIG. 4(*a*) is a vertical section view showing dual tubing straddling the lateral junction in more detail.
Figure 4A:
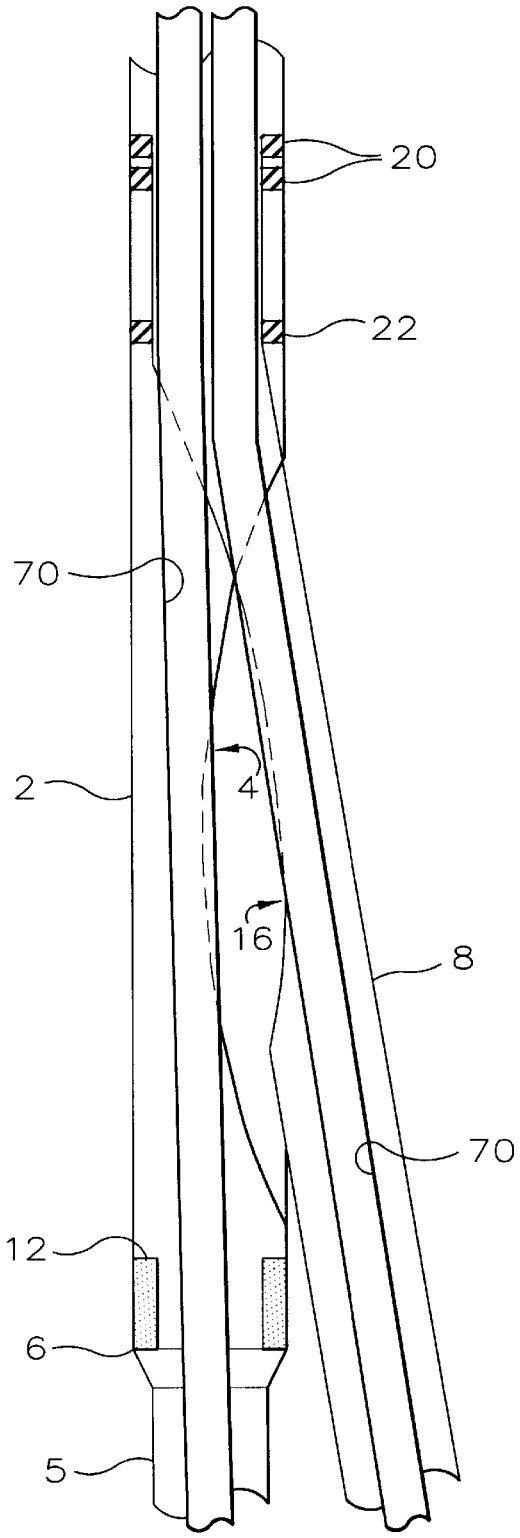
Figure 4B:
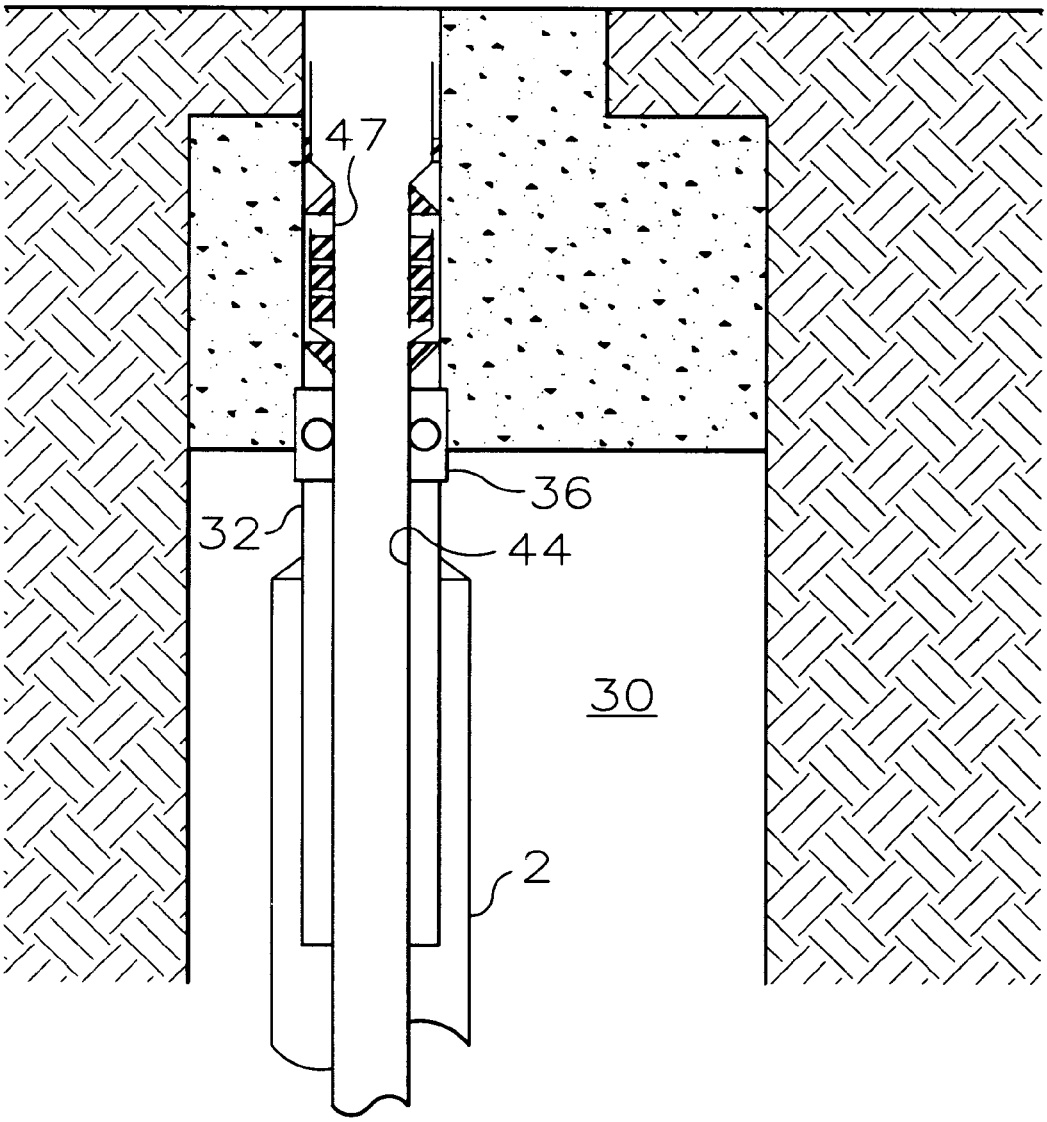
Figure 4C:
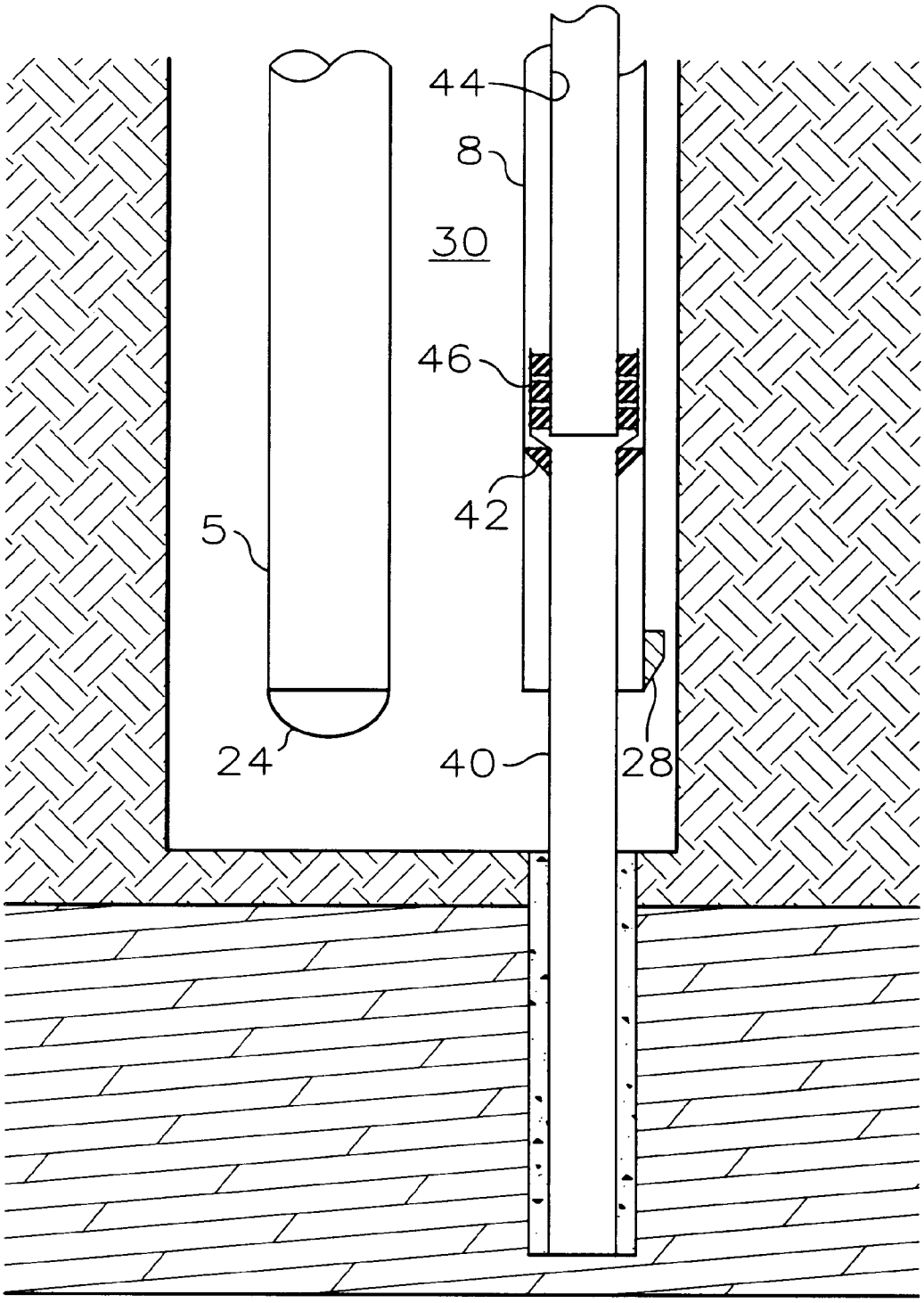

Referring now to FIG. 4(*a*)–(*c*), there is illustrated the general use of straddle equipment for pressure integrity during drilling and production operations with the multilateral tool 7. FIG. 4(*a*), which is a vertical section, shows the lateral junction in greater detail, where the lateral section 8 is fully extended out of the preformed window 4 of the carrier section 2 at a very small angle. Preferably the diversion angle formed by the axes of the lateral section and the carrier section is less than 2½ degrees, and more preferably the angle is in a range of from about ½ to about 2½ degrees. As shown, the window 16 is positioned in alignment with the longitudinal axis of the carrier casing section 2 to permit recovery of the whipstock 10 (not illustrated in FIG. 4(*a*)) through the window 16 with conventional tools. A well production tubing configuration is illustrated in FIG. 4(*a*), where dual tubing strings 70, which straddle the lateral junction at the windows 4 and 16 and extend to the surface, are illustrated. However, as previously illustrated with reference to FIG. 2, individual scab tieback liners in the main or lateral casing strings can also be advantageously employed during drilling operations. Details of scab tieback liners are illustrated in FIG. 4(*b*) and 4(*c*), which schematically show the use of tieback liner-top packers 47, and tieback seal assemblies 46 for the tubing 44 in more detail compared to FIG. 2.

Figure 5:
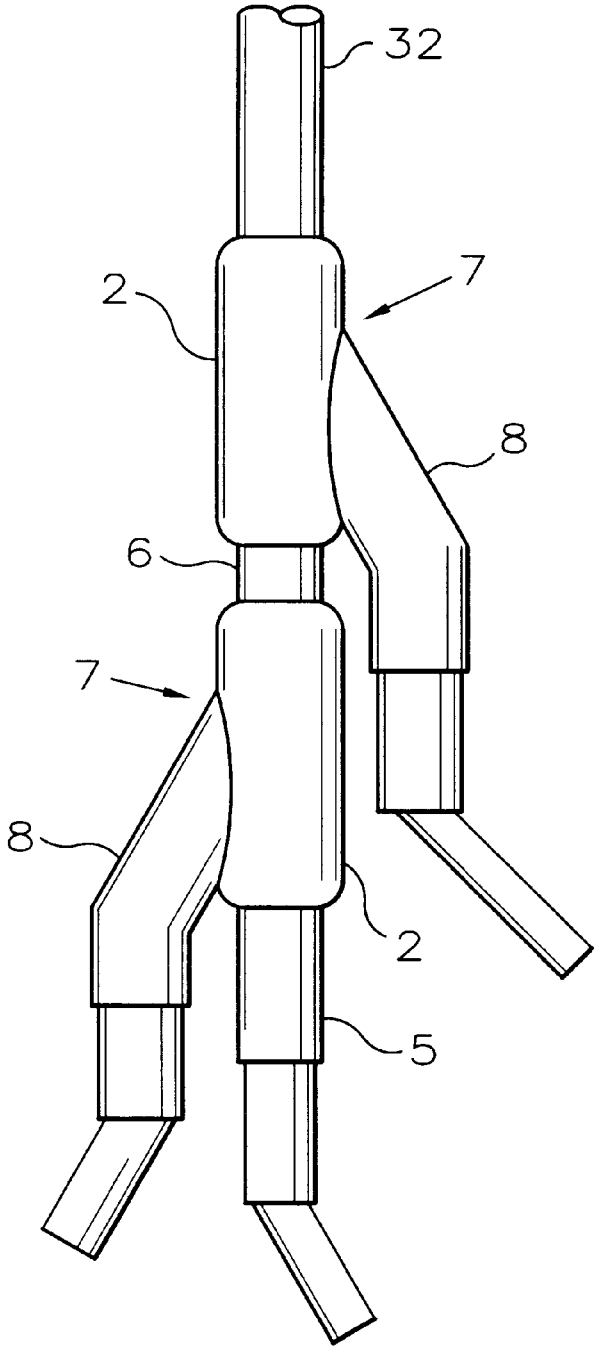
FIG. 5 is a schematic view illustrating plural multilateral tools run on a single main casing string.

Referring now specifically to FIG. 5, there is illustrated a schematic view of a well in which two (or more) multilateral tools are employed in a single primary wellbore, with drilling and completion of multiple deviated or generally horizontal wells extending from the single wellbore.

The multilateral wells for oil production, and specific design information described in this specification exemplifies only one embodiment of this invention. Clearly, many of the principles disclosed herein can be advantageously applied to other types of earth drilling operations such as: production of natural gas or other gases; production of in-situ generated coal bed gases; solution mining of salt or other minerals; steam production from geothermal reservoirs; injection of natural gas or other fluids for reservoir pressure maintenance; underground disposal or storage of liquids or gases; where any of the above operations can be conducted simultaneously in one or more lateral branches established according to this invention.

The invention as described and illustrated herein is an effective method and apparatus for rapidly establishing a multilateral well where full size casing diameters and pressure integrity are maintained through a branch junction. However, those skilled in the art of well drilling will recognize that many modifications and variations of the present invention are possible in light of the above teachings without departing from the invention. Accordingly, it should be clearly understood that the present invention is not intended to be limited by the particular features described and illustrated in the drawings, but the concept of the present invention is to be measured by the scope of the appended claims.

That which is claimed is:

1. A multilateral tool for reducing the time required for drilling and completing a multilateral well, said multilateral tool comprising:

(a) a main casing section:

(b) a carrier casing section having a first end coaxially connectable to a primary casing and a second end connectable to said main casing section, and having a first preformed window near said second end thereof;

(c) a lateral casing section having a first end and a second end, and having a second preformed window near said first end thereof;

(d) wherein said carrier casing section is adapted for closely receiving said lateral section coaxially, with said first end of said carrier casing section being adjacent to said first end of said lateral casing section when said lateral casing section is received in said carrier casing section and (e) means for releasably holding said lateral casing section within said carrier casing section;

(f) diverting means positioned in said second end of said carrier casing section for diverting said lateral casing section through said first preformed window when said lateral casing section is advanced toward said second end of said carrier casing section; and (g) wherein said carrier casing section and said primary casing section are coaxially aligned and said second preformed window is aligned with the bore of said primary casing when said lateral casing section is fully extended through said first preformed window, thereby permitting recovery of said diverting means through said second preformed window.

2. A multilateral tool in accordance with claim 1, additionally comprising:

means for longitudinally advancing said lateral casing section toward said second end of said carrier casing section, wherein a major length of said lateral casing section is extended out through said first preformed window at an angle with respect to the longitudinal axis of said carrier casing section when said lateral casing section is fully advanced in said carrier casing section; and wherein said angle is in a range of from about 0.5 degrees to about 2.5 degrees to facilitate running said major length of said lateral casing section substantially parallel to said main casing section when extended through said first preformed window.

3. A multilateral tool in accordance with claim 1, wherein said lateral casing section is received in said carrier casing section with said second preformed window oriented in the opposite direction of said first preformed window and held therein by at least one shear pin, said means for advancing said lateral casing section within said carrier casing section additionally comprising:

slidable seal means for sealing an annulus formed between said carrier casing section and said lateral casing section;

a landing collar formed on the inner surface of said first end of said carrier casing section;

an opening plug for landing on said landing collar, wherein said opening plug seals said first end of said carrier section when landed on said landing collar;

means for applying fluid pressure on said opening plug causing sufficient force to sever said at least one shear pin, and advance said lateral casing section longitudinally along the inner surface of said carrier casing section and outwardly through said first preformed window.

4. A multilateral tool in accordance with claim 1, additionally comprising:

means for recovering said diverting device, wherein said diverting device is withdrawn through said second preformed window when said lateral casing section is fully extended, and further wherein dual casing strings connected to said carrier section, are formed by said main casing section and said lateral casing section when said diverting device is recovered.

5. A multilateral tool in accordance with claim 1, wherein said diverting means comprises a whipstock.

6. A multilateral tool in accordance with claim 1, wherein the inside diameter of said main casing section and said lateral casing section are each equal to the inside diameter of said primary casing section.

7. Apparatus for providing pressure integrity in a multilateral well, said apparatus comprising:

(a) a multilateral tool connected to a primary casing in a wellbore, wherein said multilateral tool includes a lateral junction providing an unsealed connection of at least a first and a second casing string to said primary casing;

(b) a first intermediate liner casing section extending said first casing string into a subterranean formation; and (c) a first scab tieback liner connecting the upper end of said first intermediate liner casing section to the lower end of said primary casing, so as to straddle said lateral junction in said multilateral tool and provide pressure integrity for said first casing string for further drilling in said first casing string.

8. Apparatus in accordance with claim 7, wherein said first scab tieback liner is removed, said apparatus additionally comprising:

a second intermediate liner section extending said second casing string into a subterranean formation;

a second scab tieback liner connecting the upper end of said second intermediate liner to the lower end of said primary casing, so as to straddle said lateral junction in said multilateral tool and provide pressure integrity for said second casing string for further drilling in said second casing string.

9. Apparatus in accordance with claim 8, wherein said second scab tieback liner is removed, and said first and second casing strings have been extended into hydrocarbon producing formations by running corresponding first and second production liners, said apparatus additionally comprising:

a first tieback tubing extending from the top of said first production liner to the surface, wherein said first tieback tubing straddles said lateral junction for producing fluids through said first tieback tubing; and a second tieback tubing extending from the top of said second production liner to the surface, wherein said second tieback tubing straddles said lateral junction for producing fluids through said second tieback tubing.

10. Apparatus in accordance with claim 7, wherein the internal diameter of said first and said second casing string is constant across said lateral junction in said multilateral tool.

11. A method for establishing multilateral wells with pressure isolation between wells, wherein a single primary casing positioned in an enlarged wellbore section is expanded to form at least dual casing strings, said method comprising the steps of:

(a) running a multilateral tool connected to said primary casing into said enlarged wellbore section, wherein said multilateral tool includes a lateral junction providing an unsealed connection of at least a first and a second casing section to said primary casing to provide at least a first and second casing string;

(b) drilling a first hole for extending said first casing string;

(c) running and cementing a first intermediate liner section into said first hole, thereby extending said first casing string;

(d) providing a first scab tieback liner from the upper end of said first intermediate liner section to the lower end of said primary casing so as to straddle said lateral junction in said multilateral tool and thus provide pressure integrity for said first casing string; and (e) providing a first production liner extending from the lower end of said first intermediate liner in said first casing string.

12. A method in accordance with claim 11, wherein said first scab tieback liner is removed from said first casing string, said method additionally comprising:

drilling a second hole for extending said second casing string;

running and cementing a second intermediate liner section into said second hole, thereby extending said second casing string;

providing a second scab tieback liner from the upper end of said second intermediate liner section to the lower end of said primary casing so as to straddle said lateral junction in said multilateral tool and thus provide pressure integrity for said second casing string; and providing a second production liner extending from the lower end of said second intermediate liner in said second casing string.

13. A method in accordance with claim 12, wherein said second scab tieback liner is removed from said second casing string, said method additionally comprising:

providing a first tieback tubing extending from the upper end of said first intermediate liner to the surface, wherein said first tieback tubing straddles said lateral junction in said multilateral tool for producing fluids through said first tieback tubing; and providing a second tieback tubing extending from the upper end of said second intermediate liner to the surface, wherein said second tieback tubing straddles said lateral junction in said multilateral tool for producing fluids through said second tieback tubing.

14. A method in accordance with claim 13, wherein a first fluid is produced through said first tieback tubing and a second fluid is injected through said second tieback tubing.

15. A method in accordance with claim 13, wherein fluid is produced through said first tieback tubing from a hydrocarbon reservoir at a first pressure, and fluid is produced through said second tieback tubing from a hydrocarbon reservoir at a second pressure that differs from said first pressure.

16. A method in accordance with claim 13, wherein fluid produced through said first tubing is commingled with fluid produced through said second tubing.

17. A method in accordance with claim 11, wherein said multilateral tool comprises:

(a) a main casing section:

(b) a carrier casing section having a first end connectable to a primary casing and a second end connected to said main casing section, and having a first preformed window near said second end thereof;

(c) a lateral casing section having a first end and a second end, and having a second preformed window near said first end thereof;

(d) wherein said carrier casing section is adapted for closely receiving said lateral section coaxially, with said first end of said carrier casing section being adjacent to said first end of said lateral casing section when said lateral casing section is received in said carrier casing section;

(e) means for releasably holding said lateral casing section within said carrier casing section;

(f) diverting means positioned in said second end of said carrier casing section for diverting said lateral section through said first preformed window when said lateral casing section is advanced toward said second end of said carrier casing section; and (g) wherein said second preformed window is aligned with the bore of said primary casing when said lateral section is fully extended through said first preformed window, thereby permitting recovery of said diverting means through said second preformed window, and wherein said method additionally comprises the following steps:

landing an opening plug on a landing collar formed on the inner surface of the first end of said lateral casing section, thereby sealing said first end of said lateral casing section;

applying fluid pressure on said first end of said opening plug of sufficient magnitude for advancing said lateral section longitudinally in said carrier section, wherein said second end of said lateral casing section is diverted out of said first preformed window; and further advancing said lateral casing section to a fully extended position, wherein said second preformed window is centered about the longitudinal axis of said primary casing.

* * * * *